US008518193B2

(12) United States Patent
Duan et al.

(10) Patent No.: US 8,518,193 B2
(45) Date of Patent: Aug. 27, 2013

(54) LOW DENSITY BE-BEARING BULK GLASSY ALLOYS EXCLUDING LATE TRANSITION METALS

(75) Inventors: Gang Duan, Chandler, AZ (US); Aaron Wiest, Los Angeles, CA (US); William L. Johnson, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 1353 days.

(21) Appl. No.: 11/856,544

(22) Filed: Sep. 17, 2007

(65) Prior Publication Data

US 2008/0121316 A1 May 29, 2008

Related U.S. Application Data

(60) Provisional application No. 60/845,358, filed on Sep. 18, 2006.

(51) Int. Cl.
*C22C 45/10* (2006.01)
*C22C 45/00* (2006.01)

(52) U.S. Cl.
USPC ..... 148/561; 148/403

(58) Field of Classification Search
None
See application file for complete search history.

(56) References Cited

U.S. PATENT DOCUMENTS 3,989,517 A 11/1976 Tanner et al.
4,050,931 A 9/1977 Tanner et al.
5,288,344 A 2/1994 Peker et al.
7,017,645 B2 3/2006 Johnson et al.

FOREIGN PATENT DOCUMENTS

GB 1474837 * 5/1977

OTHER PUBLICATIONS

Guo et al, "Ductile titanium-based glassy alloy ingots", Applied Physics Letters, 2005, vol. 86, pp. 091907-1 to 09197-3.
Inoue, High Strength Bulk Amorphous Alloys with Low Critical Cooling Rates (Overview), JIM, Jul. 1995, vol. 36, No. 7, pp. 866-875.
Peker et al., "A highly processable metallic glass:$Zr_{41.2}Ti_{13.8}Cu_{12.5}Ni_{10.0}Be_{22.5}$", Appl. Phys. Lett. Oct. 25, 1993, vol. 63, No. 17, pp. 2342-2344.

* cited by examiner

*Primary Examiner* — Patrick Ryan
*Assistant Examiner* — Yoshitoshi Takeuchi
(74) *Attorney, Agent, or Firm* — Dorsey & Whitney LLP

(57) ABSTRACT

Low density Be-bearing bulk amorphous structural alloys with more than double the specific strength of conventional titanium alloys and methods of forming bulk articles from such alloys having thicknesses greater than 0.5 mm are provided. The bulk solidifying amorphous alloys described exclude late transition metal components while still exhibiting good glass forming ability, exceptional thermal stability, and high strength.

17 Claims, 10 Drawing Sheets

LOW DENSITY BE-BEARING BULK GLASSY ALLOYS EXCLUDING LATE TRANSITION METALS

CROSS-REFERENCE TO RELATED APPLICATIONS

The current application claims priority to U.S. Provisional Application No. 60/845,358 filed on Sep. 18, 2006, the disclosure of which is incorporated herein by reference.

STATEMENT OF FEDERAL FUNDING

The U.S. Government has certain rights in this invention pursuant to Grant No. DMR0520565 awarded by the National Science Foundation.

FIELD OF THE INVENTION

The current invention is directed generally to novel bulk solidifying amorphous alloys, and more particularly to low density Be-bearing bulk solidifying amorphous alloys that do not incorporate significant fractional volumes of any late transition metal components.

BACKGROUND OF THE INVENTION

Metallic alloys that are amorphous or glassy at low temperatures have been known in the prior art for a number of years. Amorphous alloys differ from ordinary metals in that these materials can be undercooled and remain as an extremely viscous liquid phase or glass at ambient temperatures when cooled sufficiently rapidly, whereas ordinary metals crystallize when cooled from the liquid phase.

Because metals naturally tend toward crystalline structures, the formation of amorphous metallic alloys has always faced the difficulty that the undercooled alloy melt tends toward crystallization. In short, to form an amorphous solid alloy one must coot a molten starting material from the melting temperature to below the glass transition temperature as quickly as possible to avoid crystallizing the metal. As a result, initial efforts to make amorphous alloys focused on a broad range of compositions that would form amorphous alloys when cooled at rates on the order of $10^4$ to $10^6$ K/sec. To achieve such rapid cooling rates, a very thin layer (e.g., on the order of 10s to 100s of micrometers) or small droplets of molten metal were brought into contact with a conductive substrate maintained at near ambient temperature. For example, early amorphous alloys were made by melt-spinning onto a cooled substrate, thin layer casting on a cooled substrate moving past a narrow nozzle, or by "splat quenching" droplets between cooled substrates. That these techniques were favored is the result of the need to extract heat at a sufficient rate to suppress crystallization, but as a consequence of these techniques early amorphous alloys were only available as ribbons, sheets or powders with very small cross-sectional dimensions.

A typical example of this early work was done by Tanner et al., see for example, U.S. Pat. Nos. 3,989,517 and 4,050,931, the disclosures of which are incorporated herein by reference. In these patents it was reported that amorphous ribbons (typically only 30 μm thick) could be made from Ti—Be, Zr—Be and Ti—Zr—Be systems at very high cooling rates of ~$10^6$ K/s. Techniques suggested for use in forming amorphous alloys from these materials included, for example, splat quenching and melt spinning techniques. However, again the amorphous materials made from these alloys were limited by the size of the techniques to thin ribbons, sheet or powders. No bulk glass formers were ever identified in the binary systems or the ternary Ti—Zr—Be system, and indeed to date it is convention that such ternary beryllium alloys require cooling rates on the order of $10^6$ K/s to maintain their amorphous properties.

Later studies tried to identify amorphous alloys with greater resistance to crystallization so that less restrictive cooling rates could be utilized, allowing in turn for the production of thicker bodies of amorphous material. The casting dimensions required to maintain the material in an amorphous state is referred to as the critical casting thickness. One class of materials that has garnered a great deal of attention over the past twenty years are bulk metallic glasses (BMG). These materials are noted for their high glass forming ability (GFA), good processability and exceptional stability with respect to crystallization. In addition these materials also exhibit high strength, elastic strain limit, wear resistance, fatigue resistance, and corrosion resistance. To date, families of binary and multi-component systems have been designed and characterized to be BMG if they readily form amorphous structures upon cooling from the melt at a rate less than $10^3$ K/s. This low cooling rate allows for the fabrication of bulk parts with critical casting thicknesses formerly unattainable with traditional amorphous materials.

Prior research results teach that Beryllium bearing amorphous alloys require the presence of at least one Early Transition Metal (ETM) and at least one Late Transition Metal (LTM) in order to form BMGs. Indeed, it has long been believed that BMGs containing certain LTMs (e.g., Fe, Ni, Cu) have advantages including better glass forming ability, higher strength and elastic modulus, and lower materials cost. One exemplary set of bulk solidifying amorphous alloys are the highly processable Zr—Ti—Cu—Ni—Be BMGs (sold under the tradename Vitreloy® and disclosed in U.S. Pat. No. 5,288,344, the disclosure of which is incorporated herein by reference), which have been used commercially for a variety of items from sporting goods to electronic casings.

However, because of the high density of the LTMs used in these conventional BMGs, they have much higher densities than alloys excluding LTMs. For example, Vitreloy alloys have typical densities of ~6 g/cc or above, and are therefore limited in their uses in structural applications, which usually require low density/high specific strength materials. For example, most structural metals, such as the conventional titanium alloys traditionally used in aerospace industries have a combination of high specific strength and low density. None of the prior art Ti-based LTM containing BMGs have material properties that compare to that of conventional titanium materials, such as, for example, pure titanium or Ti6Al4V alloy. For example, recently BMG forming alloys in the form of glassy ingots were discovered in the Ti—Zr—Ni—Cu—Be system. (See, e.g., F. Q. Guo, H. J. Wang, S. J. Poon, and G. J. Shiflet, Applied Physics Letters 86, 091907 (2005), the disclosure of which is incorporated herein by reference.) Amorphous rods with critical casting thicknesses up to 14 mm were successfully produced; however, for a typical $Ti_{40}Zr_{25}Ni_3Cu_{12}Be_{20}$ alloy, a density of ~5.4 g/cc was obtained. This is much higher that the density of pure titanium, which is ~4.52 g/cc.

Accordingly, it would be highly desirable to obtain a class of BMGs with a density on par with that of pure titanium or other conventional titanium based structural materials and the high strength, elastic strain Limit, wear resistance, fatigue resistance, and corrosion resistance properties of prior art BMGs. Such a class of materials would be particularly good for structural applications where specific strength and specific modulus are key figures of merit.

SUMMARY OF THE INVENTION

The current invention is directed to BMG alloy compositions comprising beryllium and at least two ETMs, but that includes no LTMs, and to methods of forming such BMG alloy compositions.

In one embodiment, the invention is directed to ternary BMG compositions having a base composition of Be—Ti—Zr. In such an embodiment up to 15% of the Ti or Zr can be substituted with another element. In one such embodiment the additional element is an early transition metal.

In another embodiment of the invention the ternary BMGs in accordance with the current invention readily form an amorphous phase upon cooling from the melt at a rate less than $10^3$ K/s.

In still another embodiment of the invention the BMGs in accordance with the current invention have densities less than ~6 g/cm$^3$.

The above-mentioned and other features of this invention and the manner of obtaining and using them will become more apparent, and will be best understood, by reference to the following description, taken in conjunction with the accompanying drawings. The drawings depict only typical embodiments of the invention and do not therefore limit its scope.

DETAILED DESCRIPTION OF THE INVENTION

Figure 1:
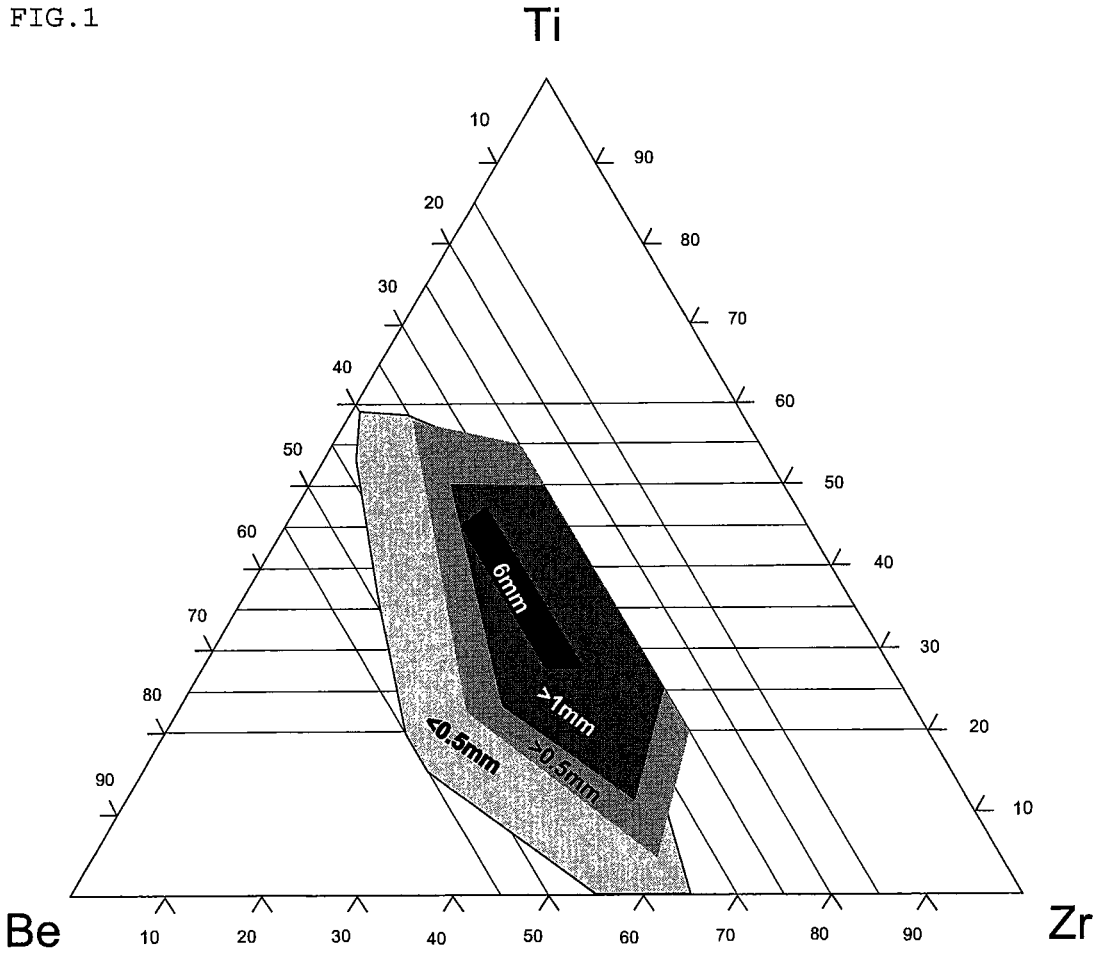
FIG. 1 provides a ternary composition diagram indicating broad and preferred glass forming regions of alloys provided in practice of this invention.

This invention relates generally to bulk amorphous alloys, commonly referred to as bulk metallic glasses (BMGs), which are composed of beryllium and at least two early transition metals (ETMs), and which do not include significant fractional volumes of any late transition metals (LTMs). The invention will be understood further with reference to the following definitions:

"Early Transition Metals" are, for the purposes of this invention, defined as elements from Groups 3, 4, 5 and 6 of the periodic table, including the lanthanide and actinide series. (The previous IUPAC notation for these groups was IIIA, IVA, VA and VIA.)

"Late Transition Metals" are, for the purposes of this invention, defined as elements from Groups 7, 8, 9, 10 and 11 of the periodic table. (The previous IUPAC notation for these groups was VIIA, VIIIA and IB.)

"Bulk Metallic Glasses" are, for the purposes of this invention, materials that form amorphous solids at cooling rates that permit the formation of objects with dimensions in all axes (critical casting thickness) being at least 0.5 mm.

"Amorphous" is, for the purpose of this invention any material that comprises at least 50% amorphous phase by volume, preferably at least 80% amorphous phase by volume, and most preferably at least 90% amorphous phase by volume as determined by X-Ray diffraction measurements.

"Lightweight" is, for the purpose of this invention defined as a material having a density less than about 6 g/cm$^3$.

At a basic level the current invention describes ternary beryllium alloys that do not contain any LTM additives in concentrations greater than trace levels, and that readily form BMGs at cooling rates that allow for the formation of amorphous articles having dimensions in all axes, or critical casting thicknesses, of greater than 0.5 mm. Generally speaking, the BMG alloys in accordance with the current invention have at least two early transition metals and beryllium. As will be described below, although a class of excellent BMG alloys can be found in the ternary beryllium alloys of the current invention, an even better family of BMG alloys, i.e., lower critical cooling rates to avoid crystallization and Lower densities, are found using quaternary alloys with at least a 5% concentration of Al. (Unless indicated otherwise, composition percentages stated herein are atomic percentages.)

Another distinguishing feature of the BMG alloys of the current invention is the absence of any substantial contribution from late transition metal (LTM) components or mixtures of late transition metals. As discussed above, for purposes of this invention, late transition metals include Groups 7, 8, 9, 10 and 11 of the periodic table. A substantial concentration of LTMs, for the purposes of this application, is any concentration greater than normal trace amounts or contaminant levels (~5%). The elimination of the LTMs allow for a 20 to 40% reduction in the density of these materials, (~4.59 g/cc, which is comparable to that of pure titanium) while maintaining the processability, exceptional thermal stability, and very high specific strength that are the hallmark of prior art BMGs.

In general terms the combination of properties offered by the alloys of the current invention allow for the fabrication of bulk parts, i.e., parts having dimensions greater than 0.5 mm in all axes (critical casting thickness) that can be used in structural elements where specific strength and specific modulus are key figures of merit. To understand why this is important, it must be understood that the resistance of a metallic glass to crystallization can be related to the cooling rate required to form the glass upon cooling from the melt (critical cooling rate). It is desirable that the critical cooling rate be on the order of from 1 K/s to $10^3$ K/s or even less. As the critical cooling rate decreases, greater times are available for processing and larger cross sections of parts can be fabricated. Further, such alloys can be heated substantially above the glass transition temperature without crystallizing during time scales suitable for industrial processing.

The critical casting thickness can be formally related to the critical cooling rate of the alloy using Fourier heat flow equations. For example, if no latent heat due to crystallization is involved, the average cooling rate R at the center of a solidifying liquid is approximately proportional to the inverse square of the smallest mold dimension L, i.e., $R \approx \alpha L^{-2}$ (L in cm; R in K/s), where the factor $\alpha$ is related to the thermal diffusivity and the freezing temperature of the liquids (e.g., $\alpha \sim 15$ $Kcm^2/s$ for Vitreloy 1 $Zr_{41.2}Ti_{13.8}Cu_{12.5}Ni_{10}Be_{22.5}$ alloy). Hence, the cooling rates associated with the formation of a 0.5 mm cast strip using the current alloy would be on the order of $10^3 \sim 10^4$ K/s.

The composition of the BMGs in accordance with the current invention can be described in accordance with a ternary phase diagram. Specifically, FIG. 1 of the current application provides a phase diagram for a Be—Ti—Zr ternary alloy system. In this diagram, there are four different shaded regions. These four shaded regions on the ternary composition diagram represent both the boundary of the prior art thin film amorphous alloys and the boundaries of the preferred and most preferred alloy compositions of the current invention, those which have a critical cooling rate for glass formation less than about $10^3$ K/s.

As shown in the composition diagram provided in FIG. 1, the prior art describes a very broad region of compositions that could be formed into "amorphous" materials at very high cooling rates. These compositions include both binary and ternary alloys in which the concentration of Be could range from as little as 25% to as much as 55%, the Zr concentration could range from around 1% to as much as 65%, and the concentration of Ti could, range from 0% to as much as 60% of the total alloy composition. (See, e.g., U.S. Pat. Nos. 3,989,517 and 4,050,931.1 However, because of the very high cooling rates required for the prior art binary and ternary alloys only thin sheets and ribbons or powders have been described. Moreover, the prior art has been universal in reporting that quaternary, quinary or even more complex alloys with at least three transition metals and beryllium are required to form metallic glasses with the lower critical cooling rates required to form BMGs. (See, e.g., U.S. Pat. No. 5,288,344, the disclosure of which is incorporated herein by reference.)

Although in one preferred embodiment the alloys of the current invention also use such ternary alloy systems, including the Be—Ti—Zr system, it has been surprisingly discovered that a limited subclass of ternary beryllium alloys incorporating at least two ETMs form metallic glasses with critical cooling rates on par with the quaternary, quinary and other complex LTM containing alloys of the prior art. Moreover, these alloys possess densities on the order of ~4 to 5 $g/cm^3$, which are significantly lower than the densities of conventional LTM containing BMGs, and are, in fact, on the order of low density titanium alloys. In addition, the BMGs of the current invention retain the very high specific strengths of conventional BMGs. For example, exemplary alloys of the current invention exhibit specific strengths of ~405 J/g ($Ti_{45}Zr_{20}Be_{35}$). In comparison, exemplary low density titanium alloys such as Ti64 (Ti-6Al-4V) exhibit specific strengths on the order of 175 J/g.

Figure 2:
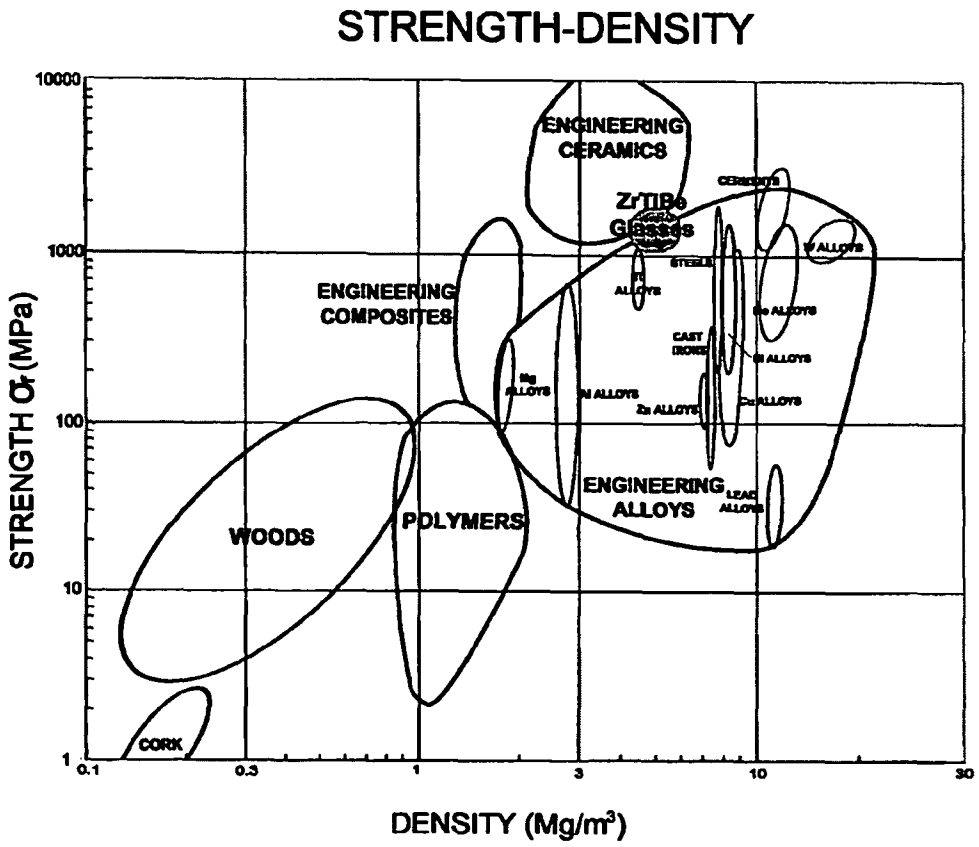
FIG. 2 provides an Ashby map comparing the strength and density of the alloys of the invention against conventional structural materials.
Figure 3:
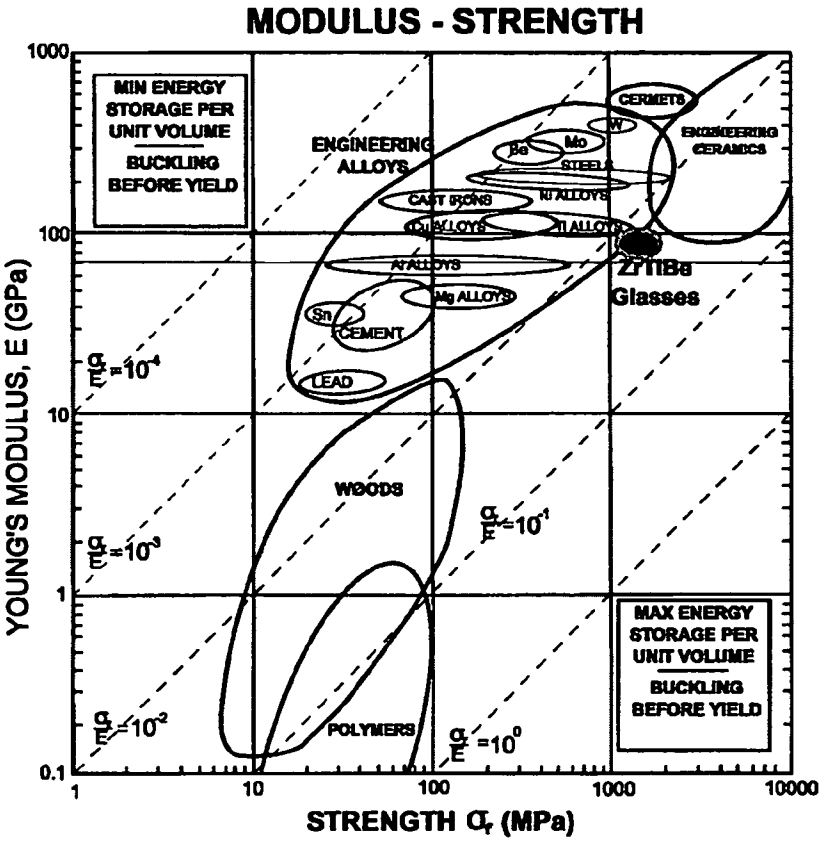
FIG. 3 provides an Ashby map comparing the strength and modulus of the alloys of the invention against conventional structural materials.

For example, FIG. 2 provides a map of strength versus density for conventional alloys such as titanium and steel, as well as ceramics and other materials against the alloys of the current invention, and FIG. 3 provides a map of modulus versus strength for the same materials. As shown, the alloys of the current invention have densities comparable to low density titanium alloys, while possessing far superior strength and modulus properties. In short, the alloys of the current invention show combinations of properties unattainable by conventional alloys, and by carefully controlling the concentrations of the individual components it is possible to obtain bulk metallic glasses that are castable in thicknesses over 6 mm (FIG. 11. Accordingly, this combination of low density and high strength/modulus make these alloys ideal for use in structural components such as, for example, aerospace and astrospace, defense, sporting good, architectural materials, automotive components, biomedical parts, and foam structures.

Turning to the compositional details of the BMGs of the current invention as set forth in FIG. 1, it is important that the alloy contains from 25 to 50 atomic percent beryllium. As shown by the smaller shaded regions of FIG. 1, it is more preferable that the beryllium content be from about 25 to 45%, and most preferably that it be from 30 to 37.5%, depending on the other metals present in the alloy.

However, the beryllium content comprises only one of the three apexes of the ternary composition diagrams set forth herein. The second and third apexes of the ternary composition diagrams of FIG. 1 are defined by the at least two early transition metal (ETM) components of the material. As shown in FIG. 1, in a preferred embodiment these ETMs are Zr and Ti. Although Ti and Zr are preferred, for purposes of this invention, an early transition metal includes Groups 3, 4, 5, and 6 of the periodic table, including the lanthanide and actinide series. The total concentration of early transition metals in the alloy is in the range of from 50 to 75 atomic percent. Preferably, the total early transition metal content is in the range of from 55 to 75%. Most preferably, the total early transition metal content is in the range of from 62.5 to 70%. The individual contributions from Ti and Zr range from about 10% to 60%.

Another way of defining the compositional ranges for the BMGs of the current invention is by using appropriate molecular formulas. For example, the regions shown in FIG. 1 can be defined by the formula $(Zr_{1-x}Ti_x)_aBe_b$. In this formula x is an atomic fraction, and a and b are atomic percentages. Accordingly, since the total early transition metal content, including the zirconium and/or titanium, is in the range of from 50 to 75 atomic percent, this range defines the value of "a". Likewise, since the amount of beryllium is in the range of from 25 to 50%, this range defines the value of "b". The value of "x", meanwhile, depends on the interplay between the concentrations of Ti and Zr for each of the shaded regions. For example, for the broadest BMG forming region x is found in the range of from 0.1 to 0.9, a is in the range of from 50 to 75% and b is in the range of from 25 to 50%. Preferably x is in the range of from 0.3 to 0.7, a is in the range of from 55 to 75% and b is in the range of from 25 to 45%. Most preferably x is in the range of from 0.3 to 0.7, a is in the range of from 62.5 to 67.5% and b is in the range of from 32.5 to 37.5%. In a particularly preferred embodiment, the BMG has a composition make up of $(Zr_{1-x}Ti_x)_{65}Be_{35}$, where x is in the range of from 0.3 to 0.7.

Figure 4:
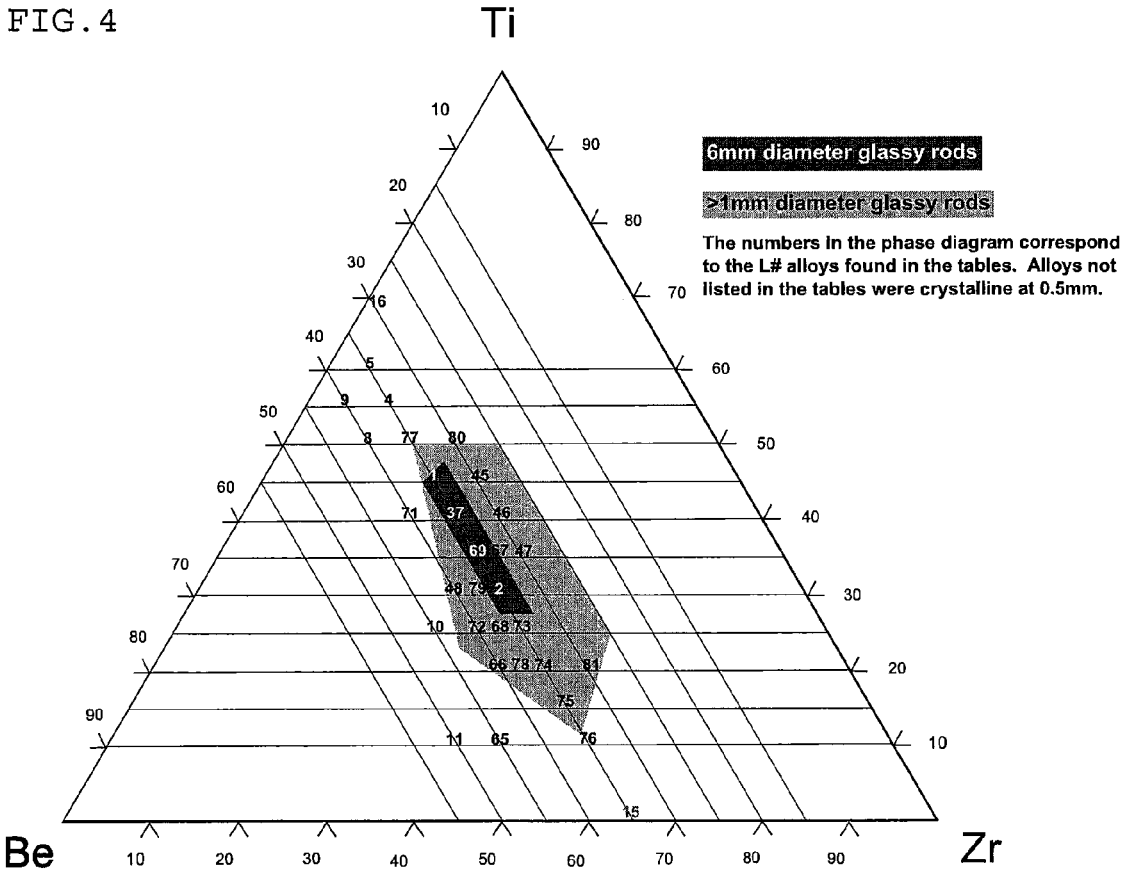
FIG. 4 provides a ternary composition diagram over which a map of the critical casting thicknesses of the alloys in the Ti—Zr—Be ternary system has been mapped.

For clarity, FIG. 4 provides a ternary composition diagram representing the preferred glass-forming compositions, as defined numerically herein, for compositions where x is in the range of from 0.3 to 0.7, a is in the range of from 55 to 75% and b is in the range of from 25 to 45%. These boundaries are the smaller size shaded areas of the ternary composition diagrams of FIG. 1. It will be noted in FIG. 4 that there are two relatively smaller shaded areas of preferred glass-forming alloys. Very low critical cooling rates, and correspondingly large critical casting dimensions, are found in both of these preferred composition ranges. As shown in the key, alloys in these categories can be formed into bulk pieces having dimensions in all axes at least greater than 1 mm, and in the particularly preferred region into pieces having dimensions in all axes of at least 6 mm.

Although the range of alloys suitable for forming the BMGs of the current invention can be defined in various ways, as described above, it should be understood that while some of the composition ranges are formed into metallic glasses with relatively higher cooling rates, preferred compositions form metallic glasses with appreciably lower cooling rates. Moreover, although the alloy composition ranges are defined by reference to a ternary system such as that illustrated in FIG. 1, the boundaries of the alloy ranges may vary somewhat as different materials are introduced. Regardless, the boundaries of the current invention encompass only those alloys which form an amorphous material (greater than 50% by volume amorphous phase) when cooled from the melting temperature to a temperature below the glass transition temperature at a cooling rate that allows for the formation of amorphous pieces having dimensions in all axes of at least 0.5 mm. Preferably the cooling rate is less than $10^3$ K/s, and most preferably less than 100 K/s.

While FIGS. 1 and 4 are strictly defined as a ternary composition plots, the diagrams could be considered quasi-ternary since many of the glass forming compositions of the current invention may comprise additional ETMs, and may be quinary or more complex compositions. For example, in addition the $(Zr_{1-x}Ti_x)$, moiety in such compositions may also include up to 15% of other ETMs and elements. In other words, such early transition metals may substitute for the zirconium and/or titanium, with that moiety remaining in the ranges described, and with the substitute material being stated as a percentage of the total alloy. Indeed, generally speaking, up to 5 percent of any early transition metal is acceptable in the glass alloy of the current invention. It can also be noted that the glass alloy can tolerate appreciable amounts of what could be considered incidental or contaminant materials. For example, other incidental elements may be present in total amounts less than about 5 atomic percent, and preferably in total amounts less than about one atomic percent. Small amounts of alkali metals, alkaline earth metals, heavy metals or even LTMs may also be tolerated. These additional materials will be described in greater detail below.

As described above, the alloys of the current invention can also contain up to 15% of a number of other E™ materials. The early transition metals are selected from the group consisting of zirconium, titanium, chromium, hafnium, vanadium, niobium, yttrium, neodymium, gadolinium and other rare earth elements, molybdenum, tantalum, and tungsten, or combinations thereof. However, the early transition metals are not uniformly desirable in the composition. Particularly preferred early transition metals are zirconium and titanium. The next preference of early transition metals includes chromium, vanadium, niobium and hafnium. Yttrium is next in the order of preference. Lanthanum, actinium, and the lanthanides and actinides may also be included in limited quantities. The least preferred of the early transition metals are molybdenum, tantalum and tungsten, although these can be desirable for certain purposes. For example, tungsten and tantalum may be desirable in relatively high density metallic glasses. Although not to be considered a complete list, the other incidental or contaminant materials may include, for example, Si, B, Bi, Mg, Ge, P. C, O, LTMs etc.

As it will be understood by those of skill in the art, the presence of elements in addition to the ETMs and beryllium can also have a significant influence. For example, it is believed that oxygen in amounts that exceed the solid solubility of oxygen in the alloy may promote crystallization. This is believed to be a reason that particularly good glass-forming alloys include amounts of zirconium, titanium or hafnium (to an appreciable extent, hafnium is interchangeable with zirconium). Zirconium, titanium and hafnium have substantial solid solubility of oxygen. Commercially-available beryllium also contains or reacts with appreciable amounts of oxygen.

Some elements included in the compositions in minor proportions can also influence the properties of the glass. For example, chromium, iron or vanadium may increase strength. The amount of chromium should, however, be limited to about 15% and preferably around 5%, of the total content of the alloy.

In addition to the early transition metals outlined above, in one particularly preferred embodiment the metallic glass alloy may include up to 15 atomic percent aluminum, with a beryllium content remaining above 25 percent, and ETM content between 50 and 65 percent. Preferably, the beryllium content of the aforementioned metallic glasses is at least 27.5 percent, the ETM content is 60 percent, and the aluminum content is in a range from 5 to 12.5 percent. Surprisingly, it has been discovered that this addition of aluminum provides improved critical cooling rates and processability, while simultaneously providing materials with even lower densities and higher strength and modulus properties.

Figure 5A:
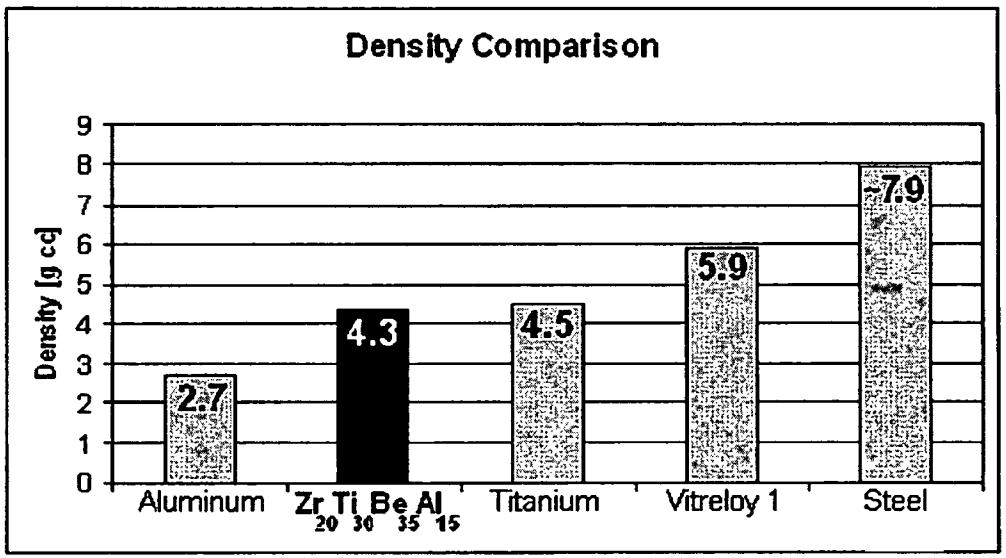
FIG. 5*a* provides bar graph comparing the density of the Al quaternary alloys of the invention against other metals.

In one particularly preferred embodiment, the Al containing alloy is $Ti_{20}Zr_{35}Be_{35}Al_{10}$. FIG. 5*a* provides a bar graph plotting the density properties of this exemplary Al containing alloy in comparison to both conventional Lightweight titanium alloys and conventional LTM containing BMGs. As shown, the density of the Al containing alloys of the current invention are well below those of the LTM containing BMGs and, in some cases, are even lower than those of the lightweight titanium alloys.

Figure 5B:
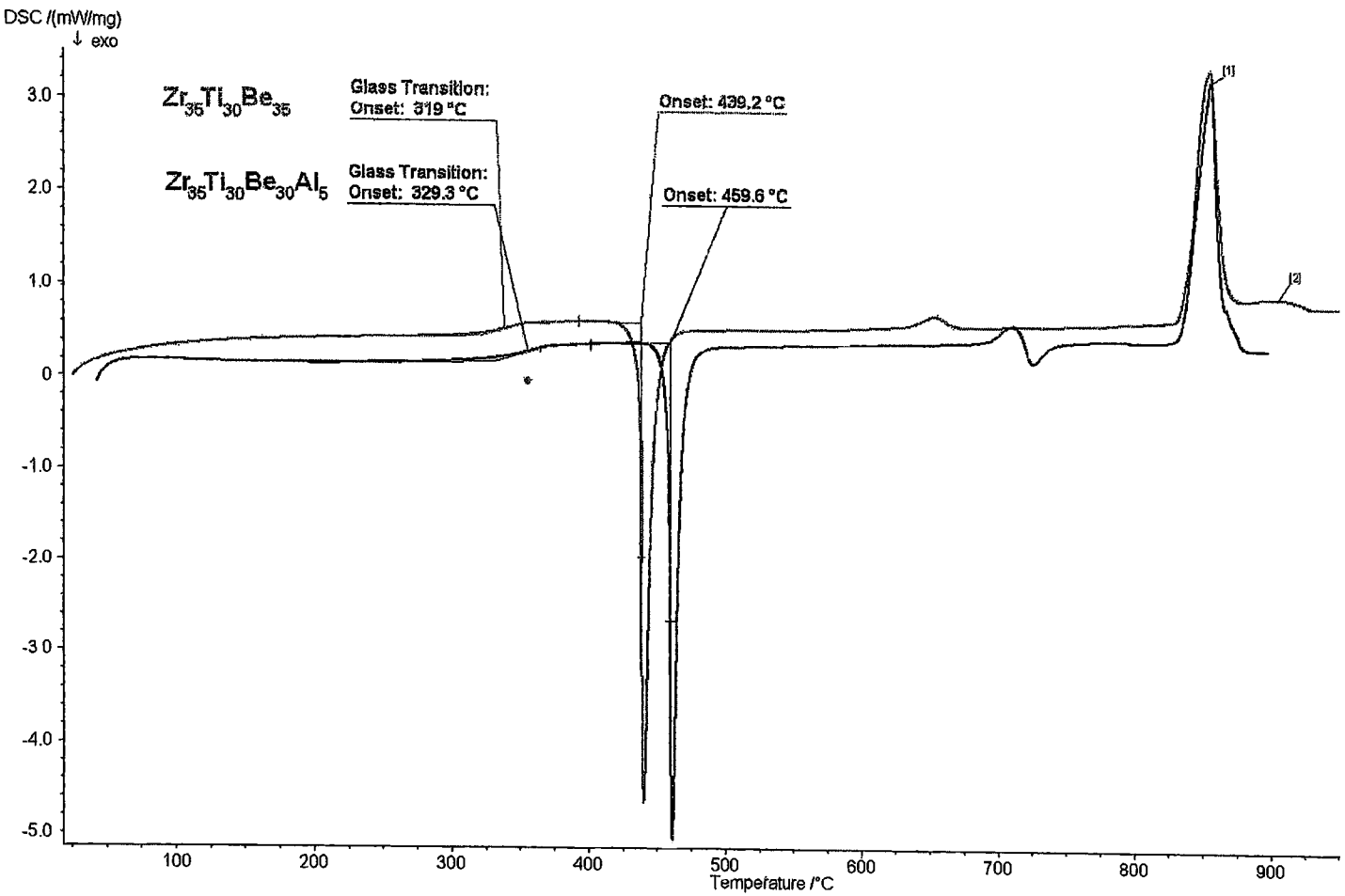
FIG. 5*b* provides comparison DSC plots for ternary and Al quaternary alloys in accordance with the current invention.
Figure 6:
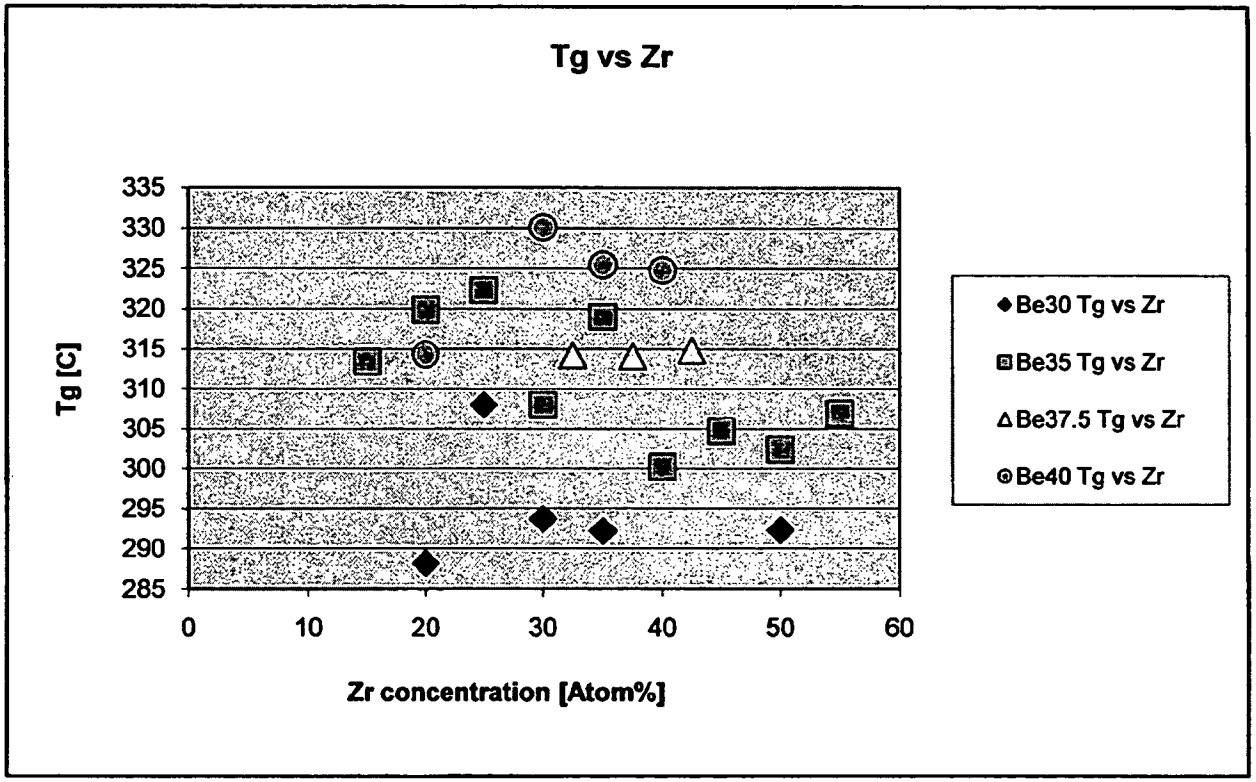
FIG. 6 provides a graph of the effect of Be concentration on the glass transition temperature of the alloys of the current invention.

In addition, these Al containing alloys show improved plastic processing properties. Plastic processing is possible for BMGs in the region between the glass transition temperature ($T_g$) and the crystallization temperature $T_x$. In this region the undercooled liquid viscosity drops steeply with temperature. A larger $T_g$–$T_x$ ($\Delta T$) value indicates a more plastically processable glass. It can be seen in the DSC plot provided in FIG. 5B that the substitution of 5% Al for Be actually increases the $\Delta T$ of the base glass and results in a quaternary glass with $\Delta T$=130 C. The largest $\Delta T$ value in the literature is 135 C making the $Zr_{35}Ti_{30}Be_{30}Al_5$ alloy one of the most plastically processable alloys known. Accordingly, alloys including between 5 and 12.5% aluminum are particularly preferred for their combination of good processability and low density.

With the variety of material combinations encompassed by the ranges described, there may be unusual mixtures of metals that do not form at least 50% glassy phase at cooling rates less than about $10^6$ K/s. Suitable combinations may be readily identified by the simple expedient of melting the alloy composition, splat quenching and verifying the amorphous nature of the sample. Preferred compositions are readily identified with lower critical cooling rates.

The amorphous nature of the metallic glasses can be verified by a number of well known methods. X-ray diffraction patterns of completely amorphous samples show broad diffuse scattering maxima, while crystallized material causes relatively sharper Bragg diffraction peaks. The relative intensities contained under the sharp Bragg peaks can be compared with the intensity under the diffuse maxima to estimate the fraction of amorphous phase present.

The fraction of amorphous phase present can also be estimated by differential thermal analysis. One compares the enthalpy released upon heating the sample to induce crystallization of the amorphous phase to the enthalpy released when a completely glassy sample crystallizes. The ratio of these heats gives the molar fraction of glassy material in the original sample.

Transmission electron microscopy analysis can also be used to determine the fraction of glassy material. In electron microscopy, glassy material shows little contrast and can be identified by its relative featureless image. Crystalline material shows much greater contrast and can easily be distinguished. Transmission electron diffraction can then be used to confirm the phase identification. The volume fraction of amorphous material in a sample can be estimated by analysis of the transmission electron microscopy images.

As previously defined, the term "amorphous metal", as employed herein, refers to a metal, which is at least 50% amorphous and preferably at least 90% amorphous, but which may have a small fraction of the material present as included crystallites.

EXAMPLES

In testing the boundaries of the inventive BMG alloys, Applicants made and tested a large number of different alloy compositions. These alloys were made and tested in accordance with the procedure set forth below.

Mixtures of elements of purity ranging from 99.9% to 99.99% were alloyed in an arcmelter with a water-cooled copper plate under a Ti-gettered argon atmosphere. Typically, 10-g ingots were prepared. Each ingot was flipped over and re-melted at least three times in order to obtain chemical homogeneity. After the alloys were prepared, the materials were cast into machined copper molds under high vacuum. These copper molds have internal cylindrical cavities of diameters ranging from 1 to 10 mm. A Philips X'Pert Pro X-ray diffractometer and a Netzsch 404C differential scanning calorimeter (DSC) with graphite crucibles (performed at a constant heating rate 0.33 K/s) were utilized to verify the amorphous natures and to examine the thermal behavior of these alloys. The elastic properties of the samples were evaluated using ultrasonic measurements along with density measurements. The pulse-echo overlap technique was used to measure the shear and longitudinal wave speeds at room temperature for each of the samples. 25 MHz piezoelectric transducers and a computer-controlled pulser/receiver were used to produce and measure the acoustic signal. The signal was measured using a Tektronix TDS 1012 oscilloscope. Sample density was measured by the Archimedean technique according to the American Society of Testing Materials standard C 693-93. Cylindrical rods (3 mm in diameter and 6 mm in height) were used to measure mechanical properties of the lightweight Be-bearing bulk glassy alloys on an Instron testing machine at a strain rate of $1\times10^{-4}$ $s^{-1}$, Before these mechanical tests, both ends of each specimen were examined with X-ray to make sure that the rod was fully amorphous and that no crystallization occurred due to unexpected factors.

A broad range of Be—Ti—Zr ternary and quaternary alloys were made and tested in accordance with the above procedure to determine the complete outline of the BMG phase diagram in accordance with the current invention. Table 1, below provides a list of some exemplary alloys in accordance with the current invention.

TABLE 1

Exemplary Be—Ti—Zr BMG Alloys

| Sample | Zr (%) | Ti (%) | Be (%) | Other (%) | $T_g$ (C.) | $T_{x1}$ (C.) | $T_{x2}$ (C.) | Enthalpy (J/g) | $T_S$ (K) | $T_l$ (K) |
|---|---|---|---|---|---|---|---|---|---|---|
| L1 | 20 | 45 | 35 | 0 | 319.9 | 380.5 | 481.2 | 145.9 | 836.2 | 848.5 |
| L2 | 35 | 30 | 35 | 0 | 319 | 439.2 | — | 127.1 | 848.6 | 861.5 |
| L6 | 50 | 25 | 25 | 0 | — | 310.7 | 412.5 | 58.17 | 864.1 | 880.6 |
| L10 | 20 | 35 | 45 | 0 | — | 450.3 | 566.9 | 162.6 | 828.7 | 876.2 |
| L12 | 20 | 35 | 35 | Al (10) | 393.8 | 500.7 | 529.2 | 110.9 | 857.6 | 948.6 |
| L13 | 20 | 40 | 35 | Al (5) | 348.8 | 457.2 | 512 | 143.2 | 847.6 | 872.7 |
| L19 | 20 | 45 | 30 | Cr (5) | 328 | 405.2 | 477.4 | 142.3 | 803 | 861.2 |
| L21 | 20 | 45 | 20 | Cr (15) | 338.1 | 445.6 | — | 50 | 795 | >950 |
| L28 | 25 | 30 | 35 | Hf (10) | 328.5 | 436.4 | — | 110 | 877.9 | 933.3 |
| L33 | 20 | 45 | 30 | Al (5) | 340 | 413.2 | 511 | 134.1 | 849.8 | 927 |
| L34 | 35 | 30 | 30 | Al (5) | 329.3 | 459.6 | — | 122.1 | 829.8 | 864.8 |
| L35 | 20 | 40 | 35 | Nb (5) | 336.9 | 422.3 | 514.1 | 127 | 848 | 900.1 |
| L37 | 25 | 40 | 35 | 0 | 322.3 | 401.7 | 469.8 | 148.3 | 845 | 850.6 |
| L38 | 20 | 40 | 35 | V (5) | 316.8 | 420.4 | 470.1 | 110.7 | 815.4 | 865.7 |
| L39 | 19.5 | 44.5 | 34.5 | Sn (1.5) | 317.9 | 414.3 | 470.3 | 131.2 | 846.4 | 901.9 |
| L40 | 19.5 | 44.5 | 34.5 | B (1.5) | 329.3 | 417.4 | 501.7 | 139.3 | 834.4 | 861 |
| L42 | 19.5 | 44.5 | 34.5 | Ge (1.5) | 329.7 | 413.4 | 513.4 | 110.8 | 831.3 | 872.5 |
| L43 | 19.5 | 44.5 | 34.5 | P (1.5) | 337.3 | 428.5 | 507.4 | 132.4 | 835.6 | 869 |
| L45 | 25 | 45 | 30 | 0 | 308 | 348.1 | 454.2 | 87.6 | 846.4 | 850.2 |
| L46 | 30 | 40 | 30 | 0 | 293.7 | 339.2 | 439.5 | 125.5 | 837.7 | — |
| L47 | 35 | 35 | 30 | 0 | 292.2 | 349 | 431.3 | 121.5 | 842.2 | — |
| L48 | 30 | 30 | 40 | 0 | 330.1 | 447.4 | — | 146.9 | 825.5 | 844.1 |
| L53 | 25 | 40 | 30 | Cr (5) | 327.1 | 419.5 | 461.1 | 104.1 | 791.6 | 826.2 |
| L65 | 45 | 10 | 45 | 0 | 346.7 | 409.7 | — | 131.3 | 870.4 | 922.1 |
| L66 | 40 | 20 | 40 | 0 | 324.8 | 415.9 | — | 127.3 | — | — |
| L67 | 32.5 | 35 | 32.5 | 0 | 299.4 | 378.5 | 444.6 | 131.3 | 870.4 | 922.1 |
| L68 | 37.5 | 25 | 37.5 | 0 | 314.1 | 413.2 | 431.4 | 137.2 | 831.1 | 857.7 |
| L69 | 30 | 35 | 35 | 0 | 308 | 412.8 | 454 | 147.3 | 837.6 | 845 |
| L71 | 20 | 40 | 40 | 0 | 314.3 | 433.2 | 488.8 | 159.6 | 829.4 | 853 |
| L72 | 35 | 25 | 40 | 0 | 325.5 | 432.4 | — | 135.2 | 836.5 | 850 |
| L73 | 40 | 25 | 35 | 0 | 300.2 | 409 | 429 | 112.3 | 838 | 934.3 |
| L74 | 45 | 20 | 35 | 0 | 304.7 | 402.7 | 423.4 | 119.4 | 876.5 | >950 |
| L75 | 50 | 15 | 35 | 0 | 302.4 | 398 | 418 | 118.2 | 879.4 | >950 |
| L76 | 55 | 10 | 35 | 0 | 306.9 | 389.4 | 415.1 | 116.1 | 904.9 | >950 |

TABLE 1-continued

Exemplary Be—Ti—Zr BMG Alloys

| Sample | Zr (%) | Ti (%) | Be (%) | Other (%) | $T_g$ (C.) | $T_{x1}$ (C.) | $T_{x2}$ (C.) | Enthalpy (J/g) | $T_S$ (K) | $T_l$ (K) |
|---|---|---|---|---|---|---|---|---|---|---|
| L77 | 15 | 50 | 35 | 0 | 313.4 | 366.1 | 503.2 | 134.5 | 829.7 | 914.5 |
| L78 | 42.5 | 20 | 37.5 | 0 | 314.8 | 405.4 | 424.4 | 123.4 | 844.5 | 880.8 |
| L79 | 32.5 | 30 | 37.5 | 0 | 314.2 | 427.5 | 441.8 | 136.5 | 836.8 | 846.8 |
| L80 | 20 | 50 | 30 | 0 | 288.2 | 331.4 | 464.9 | 125 | 829.4 | >950 |
| L81 | 50 | 20 | 30 | 0 | 292.3 | 362.9 | 422.3 | 103.7 | 880.9 | — |
| L85 | 20 | 35 | 30 | Al (15) | 393 | 498.8 | 554.2 | 167.5 | — | — |
| L87 | 20 | 45 | 27.5 | Al (7.5) | 352.3 | 415.6 | 518.4 | 133.5 | — | — |
| L90 | 20 | 30 | 35 | Al (15) | 404.1 | 530.8 | 571.6 | 155.8 | — | >1050 |

The sample numbers from the above exemplary alloys have been overlaid on the phase diagrams provided in FIG. 4. As shown, the glass formation in the Ti—Zr—Be ternary of the current invention was tested and systematically examined over an extensive region of the Ti—Zr—Be phase diagram. Surprisingly, the best glass forming region is located along the pseudo-binary line, $Ti_xZr_{(65-x)}Be_{35}$. Additional tests were performed on exemplary alloys from this region.

Figure 7:
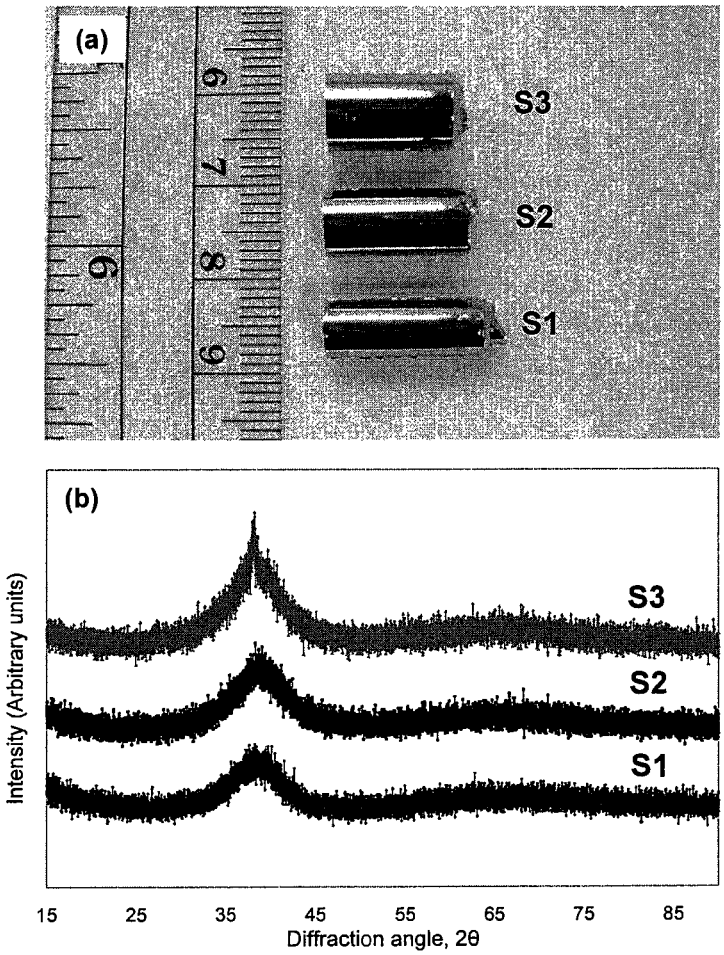
FIG. 7*a* provides photographic images of amorphous a 6 mm diameter rod of $Ti_{45}Zr_{20}Be_{35}$ (S1), a 7 mm diameter rod of $Ti_{45}Zr_{20}Be_{30}Cr_5$ (S2) and an 8 mm diameter rod of $Ti_{40}Zr_{25}Be_{30}Cr_5$ (S3)
FIG. 7*b* provides x-ray diffraction patterns for the amorphous rods of FIG. 7*a* verifying the amorphous nature of the corresponding samples.

FIG. 7*a* shows pictures of three as cast rods, $Ti_{45}Zr_{20}Be_{35}$ (S1), $Ti_{45}Zr_{20}Be_{30}Cr_5$ (S2) and $Ti_{40}Zr_{25}Be_{30}Cr_5$ (S3), having diameters of 6, 7, and 8 mm, respectively. Their as-cast surfaces appear smooth and no apparent volume reductions can be recognized on their surfaces. The X-ray diffraction patterns of S1, S2, and S3 are presented in FIG. 7*b*. S1 and S2 have X-ray patterns indicative of fully amorphous samples and S3 has a very small Bragg peak on an otherwise amorphous background indicating that the critical casting diameter has been reached. Glassy rods up to 8 mm diameter are formed by the addition of 5% Cr into the ternary Ti—Zr—Be alloys.

Figure 8:
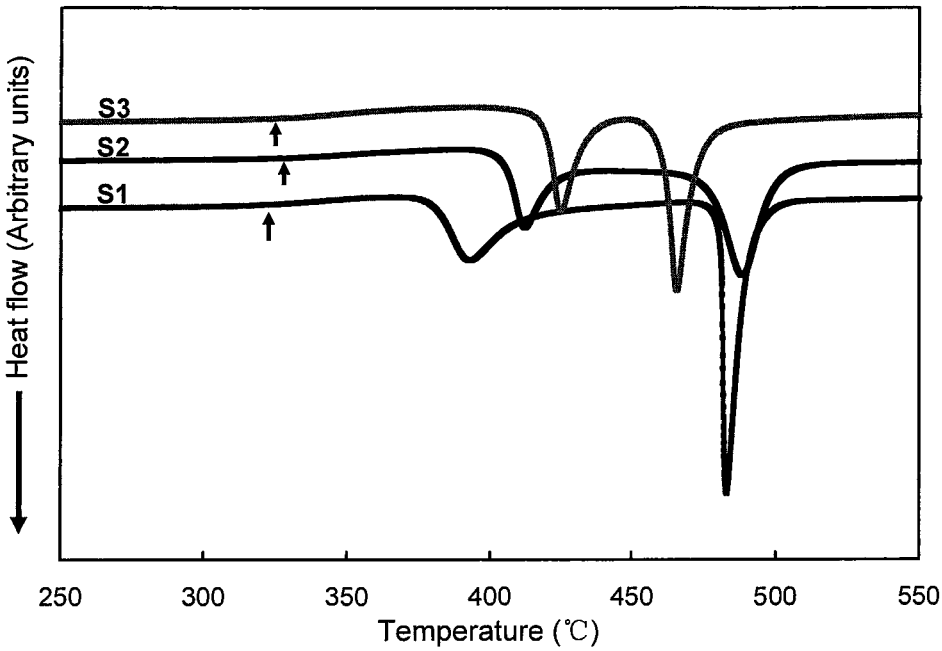
FIG. 8 provides DSC scans of the exemplary materials $Ti_{45}Zr_{20}Be_{35}$ (S1). $Ti_{45}Zr_{20}Be_{30}Cr_5$ (S2) and $Ti_{40}Zr_{25}Be_{30}Cr_5$ (S3) alloys at a constant heating rate of 0.33 K/s (arrows represent the glass transition temperatures)

Thermal behavior of these glassy alloys was measured using DSC at a constant heating rate of 0.33 K/s. The characteristic thermal parameters including the variations of supercooled liquid region, ΔT, ($\Delta T=T_x-T_g$, in which $T_x$ is the onset temperature of the first crystallization event and $T_g$ is the glass transition temperature) and reduced glass transition temperature $T_{rg}$ ($T_{rg}=T_g/T_l$, where $T_l$ is the liquidus temperature) are evaluated and listed in Table 2, below. The DSC scan signals are shown in FIG. 8. Upon heating, these amorphous alloys exhibit a clear endothermic glass transition followed by a series of exothermic events characteristic of crystallization. As is shown, Cr tends to delay the exothermic peaks, indicating a suppression of the kinetics of crystal nucleation and growth. In the Ti—Zr—Be ternary alloy system, the critical casting diameter of $Ti_{45}Zr_{20}Be_{35}$ and $Ti_{40}Zr_{25}Be_{35}$ is 6 mm (See Table 2, below). The addition of Cr increases the crystallization temperature, stabilizes the supercooled liquid, and consequently benefits the GFA.

Table 2 also presents the density, thermal and elastic properties of representative glassy alloys in Zr—Cu—Be ternary systems and other Vitreloy type BMGs. The value of $T_{rg}$ can be relatively taken as an indication of GFA. The newly developed low-density Ti—Zr—Be glassy alloys show very good thermal stability against crystallization. The best glass former $Ti_{40}Zr_{25}Be_{30}Cr_5$ possesses a large supercooled liquid region of 93 K, among the highest in the known Ti-based BMGs. It is noted that the glass transition temperatures of Ti—Zr—Be amorphous alloys fall into the same range as those of Zr—Cu—Be glasses with the same total Zr+Ti concentration.

Figure 9:
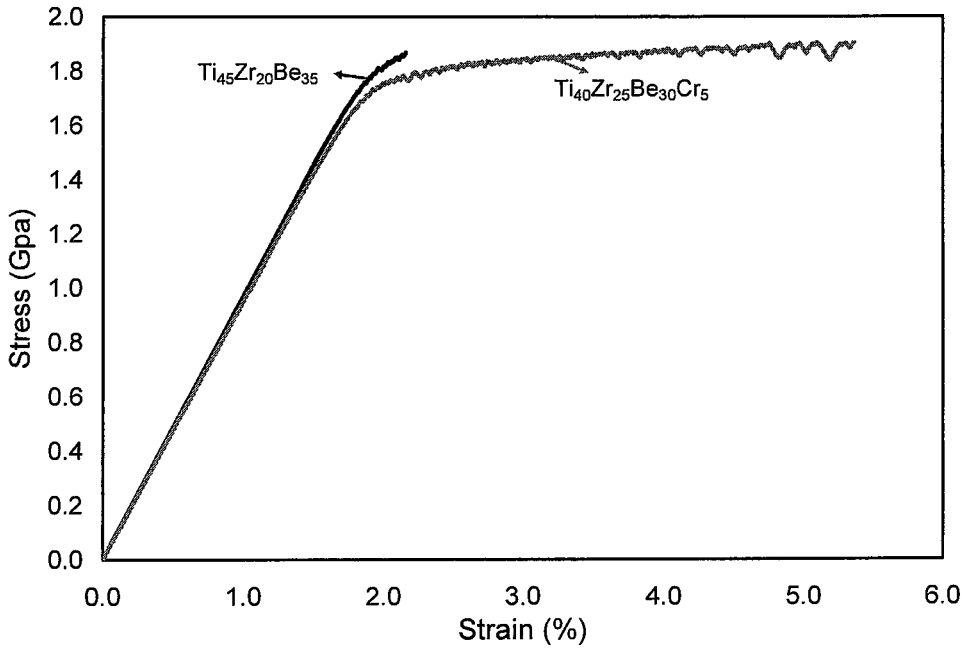
FIG. 9 provides compressive stress-strain curves for the $Ti_{45}Zr_{20}Be_{35}$ and $Ti_{40}Zr_{25}Be_{30}Cr_5$ 3 mm amorphous rods.

FIG. 9 presents the typical compressive stress-strain curves for the lightest $Ti_{45}Zr_{20}Be_{35}$ and the best glass former $Ti_{40}Zr_{25}Be_{30}Cr_5$ 3 mm amorphous rods. Compressive test indicates that $Ti_{45}Zr_{20}Be_{35}$ shows fracture strength of ~1860 MPa, with total strain of ~2.2% (mainly elastic). However, $Ti_{40}Zr_{25}Be_{30}Cr_5$ yields at ~1720 MPa, with an elastic strain limit of ~1.9%, and finally fractures at a strength of ~1900 MPa, with a plastic strain of ~3.5%.

The current study resulted in a class of bulk amorphous alloys with high GFA, good processing ability and exceptional thermal stability with mass densities significantly lower than those of the Vitreloy alloys and comparable to those of pure titanium and Ti6Al4V alloy (see Table 21. $Ti_{45}Zr_{20}Be_{35}$ and $Ti_{40}Zr_{25}Be_{30}Cr_5$ show low densities of ~4.59 and ~4.76 g/cc respectively. A 20% to 40% advantage over Vitreloy alloys in specific strength can be easily obtained. Furthermore, these lightweight Be-bearing bulk amorphous alloys are estimated to have very high specific strengths that considerably exceed those of conventional low density Titanium alloys. For example, commercial Ti6Al4V exhibits a specific strength of 175 J/g, while bulk amorphous $Ti_{45}Zr_{20}Be_{35}$ is calculated to have a specific strength of 405 J/g. For comparison, the specific strength of Vitreloy 1 ($Zr_{41.2}Ti_{13.8}Ni_{10}Cu_{12.5}Be_{22.5}$) is about 305 J/g. Thus, this class of amorphous alloys is ideal for structural applications where specific strength and specific modulus are key figures of merit.

TABLE 2

Comparison of Alloys Properties

| Material | ρ (g/cc) | d (mm) | $T_g$ (K) | $T_x$ (K) | $T_l$ (K) | ΔT (K) | $Tg/T_l$ | G (GPa) | B (GPa) | Y (GPa) | ν |
|---|---|---|---|---|---|---|---|---|---|---|---|
| $Ti_{45}Zr_{20}Be_{35}$ | 4.59 | 6 | 597 | 654 | 1123 | 57 | 0.531 | 35.7 | 111.4 | 96.8 | 0.36 |
| $Ti_{40}Zr_{25}Be_{35}$ | 4.69 | 6 | 598 | 675 | 1125 | 76 | 0.532 | 37.2 | 102.7 | 99.6 | 0.34 |
| $Ti_{45}Zr_{20}Be_{30}Cr_5$ | 4.76 | 7 | 602 | 678 | 1135 | 77 | 0.530 | 39.2 | 114.5 | 105.6 | 0.35 |
| $Ti_{40}Zr_{25}Be_{30}Cr_5$ | 4.89 | 8 | 599 | 692 | 1101 | 93 | 0.544 | 35.2 | 103.1 | 94.8 | 0.35 |
| $Zr_{65}Cu_{12.5}Be_{22.5}$* | 6.12 | 4 | 585 | 684 | 1098 | 99 | 0.533 | 27.5 | 111.9 | 76.3 | 0.39 |
| $Zr_{41.2}Ti_{13.8}Ni_{10}Cu_{12.5}Be_{22.5}$* | 6.07 | >20 | 623 | 712 | 993 | 89 | 0.627 | 37.4 | 115.9 | 101.3 | 0.35 |
| $Zr_{46.75}Ti_{8.25}Ni_{10}Cu_{7.5}Be_{27.5}$* | 6.00 | >20 | 625 | 738 | 1185 | 113 | 0.527 | 35.0 | 110.3 | 95.0 | 0.36 |

*Indicates prior art Vitreloy patents disclosed in U.S. Pat. No. 5,288,344.

Although the above disclosure and examples have focused on the alloy composition, it should be understood that the current invention is also directed to methods for forming such alloys into articles having dimensions of at least 0.5 mm in all axes. Such methods may include any conventional forming technique including all known methods of casting and molding metals. Indeed, it should be understood that the only difference between casting the BMG alloys of the current invention and molding them is that in casting the alloy is placed into a mold as a molten metal and cooled at its critical cooling rate until an amorphous part is formed, while in a molding operation first an amorphous ingot is made which is then heated above the glass transition temperature and formed by a mold. The key to both types of shaping techniques is that the material's crystallization threshold must be avoided. Such crystallization thresholds are easily determined through DSC scans, as described above.

In summary, lightweight Be-bearing bulk amorphous structural metals with low mass density, comparable to that of pure titanium, have been discovered as well as methods for forming such materials into articles having dimensions greater than at least 0.5 mm. These amorphous alloys exhibit high GFA, exceptional thermal stability, and very high specific strength. The research results have important implications on designing and developing bulk metallic glasses. The technological potential of this class of glassy alloys is very promising in a wide-variety of applications including, for example, aerospace and astrospace, defense, sporting good, architectural materials, automotive components, biomedical parts, and foam structures.

Finally, it should be understood that while preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A bulk solidifying amorphous alloy having a composition comprising:

$$(Zr_{1-x}Ti_x)_aBe_b$$

where a is an atomic percent from 62.5 to 70, b is an atomic percent from 30 to 37.5, and x is an atomic number from 0.1 to 0.9, and where the atomic percent of Zr in the alloy is at least 10% and the atomic percent of Ti in the alloy is at least 5.5%, and where the alloy is substantially free of late transition metals; and where the alloy has a critical casting thickness of at least 0.5 mm and a density less than about 6 g/cm$^3$.

2. The bulk solidifying amorphous alloy of claim 1, wherein the the atomic percent of Zr in the alloy is in the range of from about 20 to 55% and the atomic percent of Ti in the alloy is in the range of from about 10 to 50%.

3. The bulk solidifying amorphous alloy of claim 1, wherein the atomic percent of Be is in the range of from about 32.5 to 37.5%, the atomic percent of Zr in the alloy is in the range of from about 20 to 45% and the atomic percent of Ti in the alloy is in the range of from about 25 to 47.5%.

4. The bulk solidifying amorphous alloy of claim 1, further comprising up to 15% of at least one additional early transition metal.

5. The bulk solidifying amorphous alloy of claim 4, wherein the early transition metal is selected from the group consisting of chromium, hafnium, vanadium, niobium, yttrium, neodymium, gadolinium and other rare earth elements, molybdenum, tantalum, and tungsten.

6. The bulk solidifying amorphous alloy of claim 1, further comprising up to 5% of an additional. material selected from the group consisting of silicon, boron, bismuth, magnesium, germanium, phosphorous, carbon and oxygen.

7. The bulk solidifying amorphous alloy of claim 1, further comprising up to 15% aluminum content.

8. The bulk solidifying amorphous alloy of claim 7, where the alloy has an aluminum content in the range of from about 5 to 12.5%.

9. The bulk solidifying amorphous alloy of claim 1, wherein the alloy has an amorphous phase that comprises greater than 50% of the alloy by volume.

10. The bulk solidifying amorphous alloy of claim 1, wherein the alloy has an amorphous phase that comprises greater than 90% of the alloy by volume.

11. The bulk solidifying amorphous alloy of claim 1, wherein the alloy has a density of less than 5 g/cm$^3$.

12. The bulk solidifying amorphous alloy of claim 1, wherein the alloy has a critical cooling rate of less than $10^3$ K/s.

13. The bulk solidifying amorphous alloy of claim 1, wherein the alloy has a composition of $Zr_{35}Ti_{30}Be_{30}Al_5$.

14. The bulk solidifying amorphous alloy of claim 1, wherein the alloy has a critical casting thickness of greater than 1 mm.

15. The bulk solidifying amorphous alloy of claim 1, wherein the alloy has a critical casting thickness of greater than 6 mm.

16. A bulk solidifying amorphous alloy having a composition comprising:

$$(Zr_{1-x}Ti_x)_aBe_bAl_c$$

where a is an atomic percent from 50 to 75, b is an atomic percent from 25 to 50, c is an atomic percent from 5 to 15, and x is an atomic number from 0.1 to 0.9, and where the atomic percent of Zr in the alloy is at least 10% and the atomic percent of Ti in the alloy is at least 5.5%, and where the alloy is substantially free of late transition metals; and where the alloy has a critical casting thickness of at least 0.5 mm and a density less than about 6 g/cm$^3$.

17. A bulk solidifying amorphous alloy having a composition comprising:

$$Ti_xZr_{(65-x)}Be_{35}$$

where x is an atomic percent in the range of from about 10 to 45%, and where the alloy is substantially free of late transition metals; and where the alloy has a critical casting thickness of at least 0.5 mm and a density less than about 6 g/cm$^3$.

* * * * *